US006674239B1

(12) United States Patent
Westemeyer et al.

(10) Patent No.: US 6,674,239 B1
(45) Date of Patent: Jan. 6, 2004

(54) GAS DISCHARGE LAMP

(75) Inventors: Manfred Westemeyer, Aldenhoven (DE); Heinz Hüdepohl, Aachen (DE); Johannes Martinus De Regt, Cadier en Keer (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 154 days.

(21) Appl. No.: 09/616,734

(22) Filed: Jul. 14, 2000

(30) Foreign Application Priority Data

Jul. 15, 1999 (DE) ..... 199 33 023

(51) Int. Cl.[7] ..... H01J 61/54

(52) U.S. Cl. ..... 313/594; 313/234; 313/607; 313/623; 315/335

(58) Field of Search ..... 313/594, 234, 313/607, 623, 634; 315/56, 334, 335, 339

(56) References Cited

U.S. PATENT DOCUMENTS

| | | | | |
|---|---|---|---|---|
| 3,828,214 A | | 8/1974 | Keeffe et al. | 313/1 |
| 5,808,402 A | | 9/1998 | Seiler et al. | 313/318.01 |
| 5,955,856 A | * | 9/1999 | Sato et al. | 315/335 |
| 6,198,223 B1 | * | 3/2001 | Scholz | 313/234 |

FOREIGN PATENT DOCUMENTS

| | | | |
|---|---|---|---|
| DE | 2948996 A1 | 6/1981 | H01J/61/90 |
| DE | 3809623 A1 | 10/1989 | H01J/61/82 |
| EP | 0938127 A1 | 8/1999 | H01J/61/54 |

* cited by examiner

*Primary Examiner*—Ashok Patel
(74) *Attorney, Agent, or Firm*—Frank Keegan

(57) ABSTRACT

An auxiliary antenna arranged around the discharge vessel of a gas discharge lamp comprising an outer bulb enclosing this discharge vessel is provided on the outer bulb. The advantages of an auxiliary start antenna can thus be enjoyed without being counterbalanced by an increased sodium diffusion.

15 Claims, 1 Drawing Sheet

GAS DISCHARGE LAMP

BACKGROUND OF THE INVENTION

The invention relates to a gas discharge lamp with a discharge vessel enclosed by an outer bulb and an auxiliary start antenna arranged around the discharge vessel. The invention in particular relates to HID (High Intensity Discharge) lamps such as, for example, high-pressure mercury lamps, and particularly MPXL (Micro Power Xenon Light) lamps as used, for example, in motor vehicles. The discharge vessel in such a special MPXL lamp holds only a few cubic millimeters and is surrounded by a gas-filled, in particular air-filled outer bulb sealed off from the ambient atmosphere for the purpose of absorbing inter alia the ultraviolet radiation generated in the discharge.

SUMMARY OF THE INVENTION

The problem arises in these lamps that their luminous efficacy becomes higher in proportion as the pressure of the inert gas, i.e. the xenon in the case of MPXL lamps, provided in the discharge vessel (sometimes also called inner bulb or burner for short) is higher, as is described, for example, in GB 1.587.987. A higher pressure of the inert gas, however, also requires a higher ignition voltage for igniting the gas discharge, which in its turn requires igniters of higher power and more intricate, i.e. expensive construction, usually also of larger dimensions.

It has long been known, for example from EP 0 085 487 A2, EP 0 098 014 A2, or EP 0 474 277 A1, that the ignition voltage in HID lamps can be considerably reduced by means of a device usually referred to as auxiliary start antenna or just antenna for short. The known antennas are usually arranged straight alongside the discharge vessel or looped around the discharge vessel and are usually connected to a positive potential, so that they act as a kind of auxiliary electrode, as a result of which the electric field in the interior of the discharge vessel is more evenly distributed.

The known antennas, however, involve the problem that they cannot be used as they are in MPXL lamps because on the one hand the dimensions thereof are significantly smaller than those of traditional HID lamps and on the other hand said lamps become extremely hot (approximately 600° C. at the burner, approximately 400° C. at the outer bulb), so that conventional antennas are deformed, or even melt under the influence of the heat. It has also been shown that the operation of lamps whose antennas are in direct contact with or are at least arranged immediately adjacent the burner has the result that sodium present in ionized form in the burner diffuses more strongly into or even through the wall of the discharge vessel, which strongly detracts from lamp life.

The invention accordingly has for its object to provide a gas discharge lamp of the kind mentioned in the opening paragraph, in particular an MPXL lamp, in which the positive effects of an auxiliary start antenna can be utilized also in the case of small and very small discharge vessels without a high constructional expenditure and without an increased sodium diffusion being induced.

This object is achieved by means of a gas discharge lamp with a discharge vessel enclosed by an outer bulb and an auxiliary start antenna arranged around the discharge vessel wherein the auxiliary start antenna is provided against the inner or outer wall of the outer bulb. Alternatively, the auxiliary start antenna may obviously also be integrated in the outer bulb—on the basis of the same inventive idea—for example, be fused therein during blowing or molding of the bulb.

The invention accordingly is based on the surprising recognition that the ignition voltage can be considerably reduced also by means of an antenna which is not positioned immediately adjacent the discharge vessel, it being possible to reduce the typical MPXL ignition voltage of more than 10 kV by up to 40% both in the case of pulsatory ignition and in the case of resonance ignition.

The invention further has the major advantage that the complicated retaining and supporting construction partly necessary for the known antennas can be dispensed with, because the outer bulb serves as the support.

A further positive effect was found to be that MPXL lamps fitted in accordance with the invention have a clearly lower tendency to ignition failures in particular in the highfrequency range, which is caused by the fact that the antenna prevents parasitic discharge effects and retains the equipotential lines typical of the HF operation closer to the discharge vessel.

The auxiliary start antenna may be advantageously constructed in a manner which is optimally adapted to the respective application, i.e., for example, by means of a wire of an electrically well conducting material which is wound once or several times around the outer bulb, or by means of a metal ring arranged on the exterior or interior of the outer bulb. Antennas provided on the exterior of the bulb are particularly easy to realize and may be fitted without any problems in particular also on finished or at least functionally constructed MPXL lamps, which is a major advantage because the construction of an MPXL lamp is very complicated and the subsequent introduction into the construction of the antennas known until now involved a considerable cost and effort. Some lamps, moreover, do not exhibit a certain disinclination to ignite until in the practical test with certain igniters in the cold and/or hot ignition phase. It has been common practice until now in manufacture to replace the originally provided igniters with igniters of higher power, which are usually more expensive. According to the invention, it is now possible to reduce the ignition voltage by means of a simple auxiliary start antenna applied to the outer bulb without any additional constructional expenditure, instead of providing an igniter of higher power.

In a functional further embodiment of the invention, the auxiliary start antenna may be constructed as a so-called plasma antenna comprising a gas-filled annular tube in certain lamps, in which case an electrode is arranged inside the tube, which may be either a capacitive or a direct contact electrode, as required. The application of a voltage to this electrode generates a glow discharge in the tube which has the same effect as a ring, a coil, or a layer of conductive material.

A potential may be applied to the auxiliary start antenna in various ways. A particularly effective and simple method was found to be one in which the auxiliary start antenna is connected to a pole present in the discharge vessel, in particular to the return pole.

Further details and advantages of the invention will become apparent from the subsequent description of two embodiments given with reference to the drawing, in which:

BRIEF DESCRIPTION OF THE DRAWINGS

FIG. 1 shows an MPXL lamp integrally referenced 10 with a cap 12, an outer bulb 14, and a discharge vessel 16 which are diagrammatically shown. Two electrodes 18 and 20 are arranged in the discharge vessel, the electrode 20 forming the so-called return pole which is connected via a return wire 22 to components (not shown) in the cap 12, in particular to a starter.

DETAILED DESCRIPTION OF THE PREFERRED EMBODIMENTS

Figure 1:
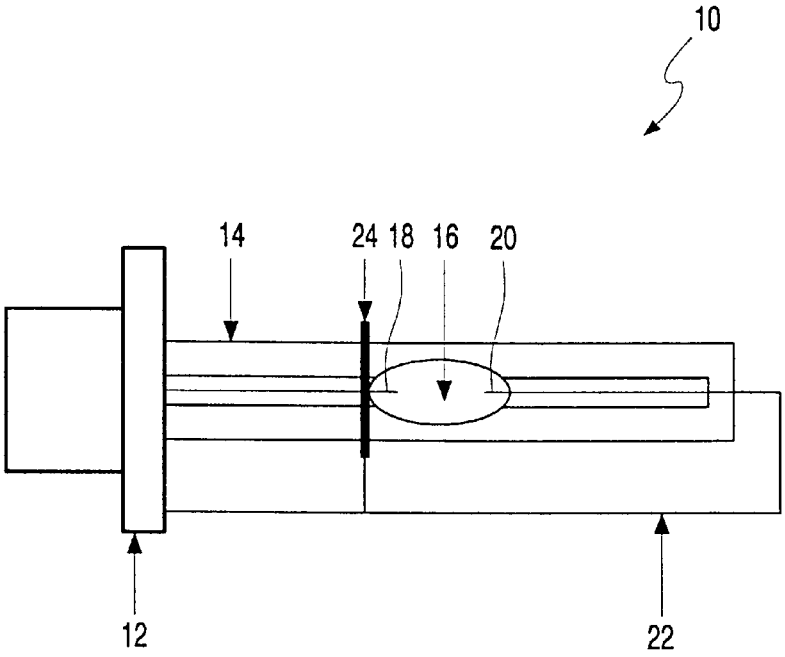
FIG. 1 shows the principle of an MPXL lamp with an annular auxiliary start antenna on the outer bulb.

An annular auxiliary start antenna 24 surrounding the outer bulb and depicted with an exaggerated height for reasons of clarity is connected to the return wire 22, which 30 antenna reduces the ignition voltage through homogenization of the field structure in the region of the electrode 18, without coming into contact with the discharge vessel 16 and without causing a measurably higher sodium diffusion into the walls of the discharge vessel 16.

Figure 2:
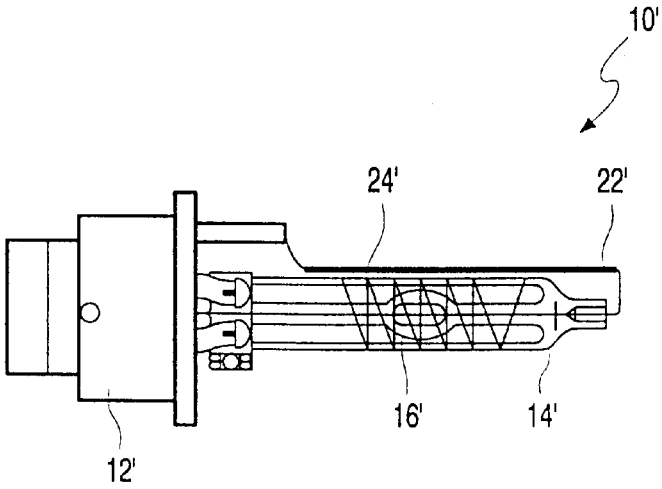
FIG. 2 shows the principle of another MPXL lamp with a wire wound several times around the outer bulb so as to form an auxiliary start antenna.

FIG. 2 shows an MPXL lamp essentially similar to the lamp of FIG. 1, the components corresponding to the components of FIG. 1 being given accented reference numerals, so that a repeated description thereof is not necessary.

The essential difference with the lamp of FIG. 1 lies in the auxiliary start antenna 24', which is formed by a wire which is wound several times around the outer bulb 14' and which is again connected to the return wire 22' in this embodiment.

Numerous modifications and further embodiments are possible within the scope of the invention, for example relating to the number and positions of the antennas. It is thus possible, for example, to provide not one but two or more rings on the outer and/or inner side of the outer bulb and/or fused into the outer bulb. Instead of a wire, a ring, or a plasma antenna, it is also possible for a layer of conductive material to be provided on or in the outer bulb. It is essential for the invention in all cases that the auxiliary start antenna is provided in or against the outer bulb in a lamp with a discharge vessel and an outer bulb which surrounds this discharge vessel.

What is claimed is:

1. A gas discharge lamp with a discharge vessel enclosed by an outer bulb and an auxiliary start antenna arranged around the discharge vessel, wherein the gas discharge lamp is a high intensity discharge lamp with a reduced discharge vessel volume, discharge vessel operating temperature of approximately 600° C. and outer bulb operating temperature of approximately 400° C. and the auxiliary start antenna is integrated into the outer bulb.

2. A gas discharge lamp as claimed in claim 1, wherein the auxiliary start antenna is formed by a wire of electrically well conducting material.

3. A gas discharge lamp as claimed in claim 1, wherein the auxiliary start antenna is formed by at least one metal ring which surrounds the discharge vessel.

4. A gas discharge lamp as claimed in claim 1, wherein the auxiliary start antenna is a plasma antenna with a gas-filled annular tube.

5. A gas discharge lamp as claimed in claim 1, wherein the auxiliary start antenna is formed by a layer of electrically conducting material on or in the outer bulb.

6. A gas discharge lamp as claimed in claim 1, wherein the auxiliary start antenna is connected to a return pole present in the discharge vessel.

7. A gas discharge lamp as claimed in claim 1, wherein the gas discharge lamp is an MPXL (Micro Power Xenon Light) lamp.

8. A high intensity discharge lamp comprising a discharge vessel enclosed by an outer bulb and an auxiliary start antenna within a wall of the outer bulb.

9. A gas discharge lamp as claimed in claim 8, wherein the gas discharge lamp is an MPXL (Micro Power Xenon Light) lamp.

10. A gas discharge lamp as claimed in claim 8, wherein the auxiliary start antenna is formed by a wire of electrically well conducting material.

11. A gas discharge lamp as claimed in claim 8, wherein the auxiliary start antenna is formed by at least one metal ring, which surrounds the discharge vessel.

12. A gas discharge lamp as claimed in claim 8, wherein the auxiliary start antenna is a plasma antenna with a gas-filled annular tube.

13. A gas discharge lamp as claimed in claim 8, wherein the auxiliary start antenna is formed by a layer of electrically conducting material.

14. A gas discharge lamp comprising a discharge vessel enclosed by an outer bulb and an auxiliary start antenna arranged around the discharge vessel, against the wall of the outer bulb, wherein the gas discharge lamp is a high intensity discharge lamp with a reduced discharge vessel volume, discharge vessel operating temperature of approximately 600° C. and outer bulb operating temperature of approximately 400° C. and the ignition voltage is in the range of 6 to 10 kV.

15. A gas discharge lamp comprising a discharge vessel enclosed by an outer bulb and an auxiliary start antenna arranged around the discharge vessel, against the wall of the outer bulb, wherein the gas discharge lamp is a Micro Power Xenon Light mercury vapor lamp with a reduced discharge vessel volume, discharge vessel operating temperature of approximately 600° C. and outer bulb operating temperature of approximately 400° C. and the ignition voltage is in the range of 6 to 10 kV.

* * * * *